US006359243B1

(12) United States Patent
Nakade et al.

(10) Patent No.: US 6,359,243 B1
(45) Date of Patent: Mar. 19, 2002

(54) MULTI-DIRECTIONAL OPERATING SWITCH AND ELECTRONIC DEVICE USING THE SAME

(75) Inventors: Yoshiyuki Nakade; Hitokazu Shitanaka; Shigeyoshi Umezawa; Naoaki Matsui, all of Fukui (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 09/768,226

(22) Filed: Jan. 25, 2001

(30) Foreign Application Priority Data

Jan. 27, 2000 (JP) ..... 2000-018419

(51) Int. Cl.[7] ..... H01H 25/04
(52) U.S. Cl. ..... 200/6 A
(58) Field of Search ..... 200/6 A; 273/148 B

(56) References Cited

U.S. PATENT DOCUMENTS 4,825,019 A * 4/1989 Fisher ..... 200/6 A
5,804,781 A * 9/1998 Okabe ..... 200/6 A
6,162,999 A * 12/2000 Ishikawa et al. ..... 200/6 A

* cited by examiner

*Primary Examiner*—Renee Luebke
(74) *Attorney, Agent, or Firm*—Wenderoth, Lind & Ponack, L.L.P.

(57) ABSTRACT

A multi-directional operating switch has a box-shaped case having an opening in an upper surface, a substrate disposed under the case, a tilting body having a manipulation shaft and disposed tiltably between the case and the substrate, and a plurality of switch units turned on and off by a depressing boss on a bottom fringe of a bowl-shaped section of the tilting body. An inner peripheral wall of the opening is provided with a plurality of recessed grooves elongated in an axial direction in positions corresponding with respective directions where the plurality of switch units are disposed, and an outer periphery of the manipulation shaft is provided with a plurality of protuberances for engagement with a corresponding one of the plurality of recessed grooves when the manipulation shaft is tilted. This structure allows for the multi-directional operating switch to have excellent operability, as any pushbutton switch other than a desired one is not turned into an ON state even if the manipulation shaft is tilted inadvertently in a direction deviated from the desired pushbutton switch.

4 Claims, 9 Drawing Sheets

MULTI-DIRECTIONAL OPERATING SWITCH AND ELECTRONIC DEVICE USING THE SAME

FIELD OF THE INVENTION

The present invention relates to a multi-direction operating switch for use in an electronic device such as an air-conditioning control device for an automobile and the like. The invention also relates to an electronic device using the same.

BACKGROUND OF THE INVENTION

FIG. 6 is a front view of an air-conditioning control device equipped with a typical operating switch of the prior art. In the past, an operating switch of this kind had a push-to-operate type configuration, and it was provided with operating buttons 17 for a number of pushbutton switches corresponding to a plurality of functions if it is adapted for switching a plurality of functions such as a blowing-out mode for delivering air into an interior space, and so on.

In recent years, multi-directional operating switches of a type that switches a plurality of functions with manipulation of one operating button instead of the operating buttons 17 of the plurality of pushbutton switches have come into use. With reference to FIG. 7 and FIG. 8, a conventional multi-directional operating switch of this kind will be described hereinafter.

FIG. 7 is a sectioned side view of a multi-directional operating switch of the prior art, and FIG. 8 is an exploded perspective view of the same. In the Figures, there is a substrate 1 made of insulation resin having an open top. The substrate 1 is provided on its bottom center surface with an upwardly projecting boss 1B having a hole-like receptacle 1A at an upper end of it. The receptacle 1A houses a supporting rod 3, which is biased upwardly by a coil spring 2, and serves as an inner support with a semispherical top end. There are two screw bosses 1C located adjacent to the boss 1B.

Six pushbutton switches 5 defining switch units are disposed in a circular configuration on an upper surface of a wiring substrate 4 made of insulation board. A center through hole 4A is inserted around the boss 1B of the substrate 1, and the wiring substrate 4 is secured to the screw bosses 1C of the substrate 1 with two screws 6. Lead wires 7 connected with the wiring substrate 4 are drawn out through a slit 1D in an outer periphery of the substrate 1, and connected electrically to an electronic circuit of an automobile (not shown in the figures).

A bowl-shaped tilting body 8 is disposed above the wiring substrate 4. The tilting body 8 is provided with a concavity 8A having a spherical upper end under a center portion of a bowl-shaped section 8D of the tilting body 8. Depressing bosses 8C, each located on a lower surface of each of six fringe arms 8B extending radially outward from a bottom edge of the bowl-shaped section 8D are in contact with their respective upper surfaces of the pushbuttons 5C of the pushbutton switches 5. There is a manipulation shaft 8E with a stepped diameter having a large diameter at its lower portion, and projecting upwardly from an upper part of the bowl-shaped section 8D.

A box-shaped case 9 having an open bottom is mounted over the substrate 1 to cover the opening on top of it. The case 9 has an opening 9A in its upper center surface in a position concentric with the supporting rod 3, which serves as an inner support of the substrate 1. There is a contact face 9B provided under a periphery of the opening 9A, the contact face 9B being in contact with an outer surface of the bowl-shaped section 8D of the tilting body 8, and serving as an outer support with its inwardly concaved semispherical shape. There are guide posts 9C projecting downward from the periphery of the contact face 9B in a such positional arrangement as to provide a predetermined space with respect to perimeters of the fringe arms 8B so as to prevent the tilting body 8 from turning about the manipulation shaft 8E.

A manipulation knob 10 has a disk-shaped manipulation surface 10A, which covers the opening 9A in the case 9, and a connection post 10B on a lower side, with which the manipulation knob 10 is connected and secured to the manipulation shaft 8E of the tilting body 8. With the foregoing structure, the manipulation knob 10 can be tiltably manipulated toward any of a plurality of directions shown by an indicator 9D, or a marking printed on the case 9.

In the multi-directional operating switch of the above-described structure, when the manipulation surface 10A of the manipulation knob 10 is tilted toward a given direction, a depressing boss 8C under one of the fringe arms 8B of the tilting body 8 corresponding to the given direction depresses a pushbutton 5C of the respective pushbutton switch 5, and opens or closes the pushbutton switch 5, while the upper end of the supporting rod 3 functions as the fulcrum, since the tilting body 8 is supported in a tiltable manner between the contact face 9B serving as the outer support provided under a periphery of the opening 9A of the case 9 and the supporting rod 3 serving as the inner support placed in the substrate 1.

The multi-directional operating switch of the prior art is so designed that by tilting the manipulation shaft 8E of the tilting body 8 correctly toward a direction where a predetermined pushbutton switch 5 is positioned, the depressing boss 8C corresponding to that direction shifts downward, and turns the predetermined pushbutton switch 5 into an ON state. During this manipulation, other depressing bosses next to that depressing boss 8C also shift downward slightly, but other pushbutton switches are not normally turned into ON state.

There has been a problem, however, that another pushbutton switch is also depressed unintentionally into its ON state at, the same time, when the manipulation shaft 8E is being tilted to the direction where a predetermined pushbutton switch 5 is positioned, if it is tilted inadvertently in a slightly deviated direction toward the another pushbutton switch next to the predetermined switch 5.

SUMMARY OF THE INVENTION

The present invention was made in consideration of the above problem of the prior art, and it aims at providing a multi-directional operating switch of excellent operability, as it avoids adjoining pushbutton switch from being depressed and turned into an ON state unintentionally even if a manipulation shaft is tilted inadvertently in a slightly deviated direction toward the adjoining pushbutton switch, and providing an electronic device using this multidirectional operating switch.

The multi multi-directional operating switch of the present invention comprises:

(a) a box-shaped case having an opening in an upper surface and an outer support provided under an outer periphery of the opening;

(b) a substrate disposed under the case and provided with an inner support in a position concentric with the opening;

(c) a tilting body provided with a bowl-shaped section supported tiltably between the inner support and the outer support, and a manipulation shaft projecting upwardly from the bowl-shaped section to the outside through the above opening; and (d) a plurality of switch units disposed in a circular configuration, and turned on and off by a depressing boss provided on a bottom fringe of the bowl-shaped section.

Further, an inner peripheral wall of the opening is provided with (1) a plurality of recessed grooves elongated in an axial direction, in positions corresponding with respective directions where the plurality of switch units are disposed, and (2) heaped-up portions projecting inwardly and elongated along the axial direction between the plurality of recessed grooves.

Furthermore, an outer periphery of the manipulation shaft is provided with (1) a plurality of raised protuberances for engaging with corresponding one of the plurality of recessed grooves in response to a tilting movement of the manipulation shaft, and (2) clearance slots, each provided on both sides of each of the plurality of protuberances for clearing the heaped-up portions during the tilting movement.

The electronic device of this invention comprises at least one of the multi-directional operating switches and a frame for mounting the multi-directional operating switches, thereby making it possible for any of the multi multi-directional switches operative to select multiple functions.

DESCRIPTION OF THE PREFERRED EMBODIMENTS

Figure 1:
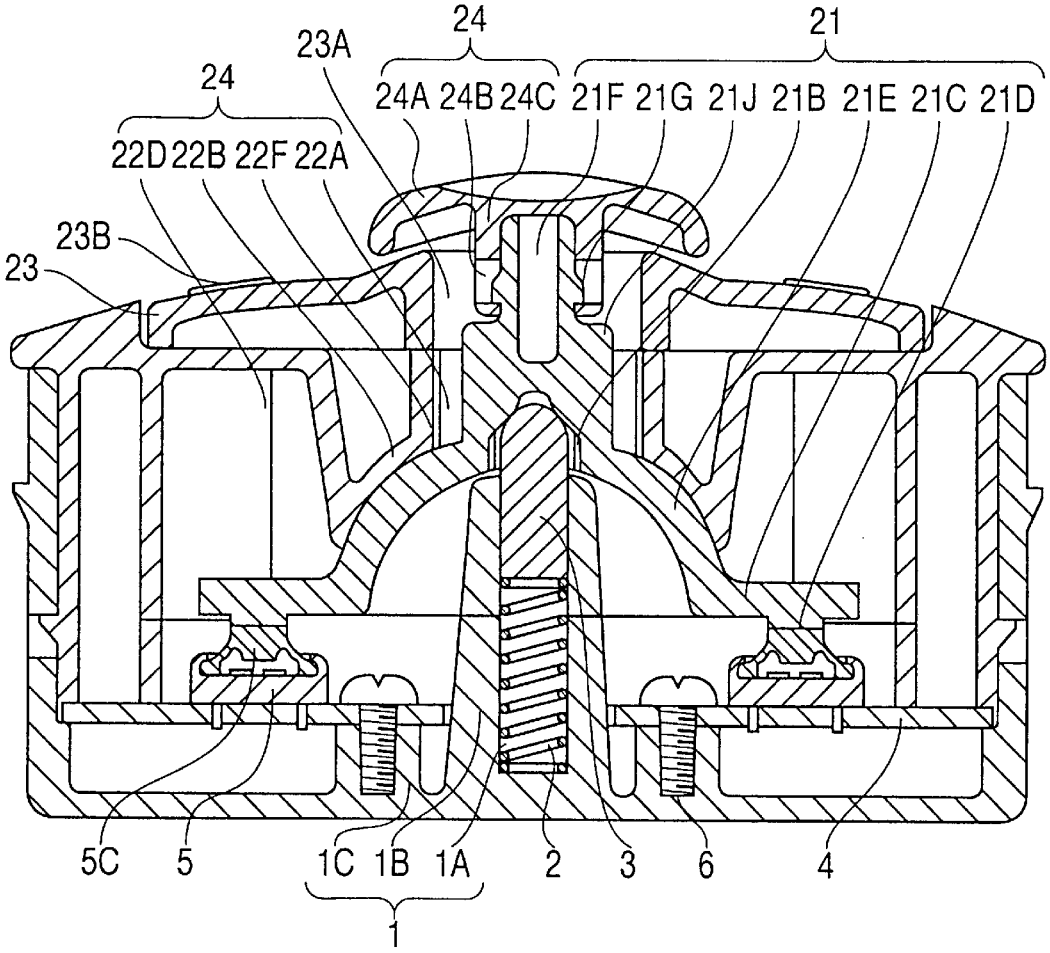
FIG. 1 is a sectioned side view of a multi-directional operating switch of a first exemplary embodiment of the present invention.

With reference to the accompanying drawings, exemplary embodiments of the present invention will be described hereinafter.

Like reference numerals are used throughout to designate constituent elements that are identical to those described in the prior art section, and their detailed descriptions will be omitted.

First Exemplary Embodiment

Figure 2:
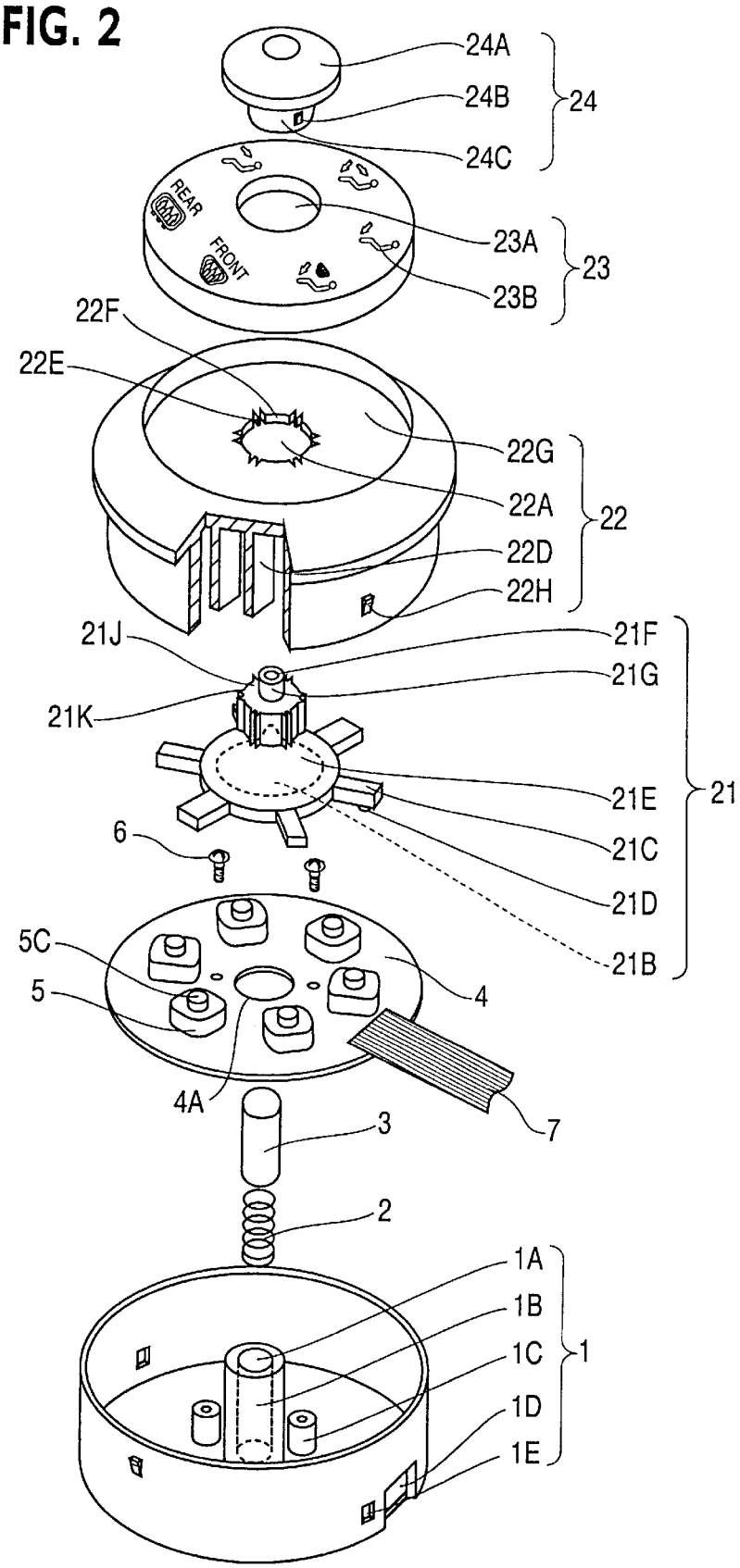
FIG. 2 is an exploded perspective view of the same multi-directional operating switch.

FIG. 1 is a sectioned side view of a multi-directional operating switch of a first exemplary embodiment of the present invention, and FIG. 2 is an exploded perspective view of the same. In the Figures, a substrate 1 is provided with a boss 1B having a hole-like receptacle 1A at an upper end of it, and screw bosses 1C located in vicinity of the boss 1B. The receptacle 1A houses within it a supporting rod 3 defining an inner support, which is biased upwardly by a coil spring 2.

Six pushbutton switches 5 defining switch units are disposed in a circular configuration on a wiring substrate 4. The wiring substrate 4 with its through hole 4A is inserted around the boss 1B of the substrate 1, and secured to an inside of the substrate 1 with screws 6. Lead wires 7 of the wiring substrate 4 are drawn out through a slit 1D, and connected electrically with an electronic circuit of an automobile (not shown in the Figures).

A bowl-shaped tilting body 21 is disposed above the wiring substrate 4. The tilting body 21 is provided with a concavity 21B having a spherical upper end under a center portion of a bowl-shaped section 21E. The tilting body 21 is also provided with six fringe arms 21C extending radially outward from a bottom edge of the bowl-shaped section 21E, and the tilting body 21 is disposed within the substrate 1 in a manner that depressing bosses 21D on lower surfaces of the fringe arms 21C come in contact with upper surfaces of their respective pushbuttons 5C of the pushbutton switches 5. There is a manipulation shaft 21F projecting upwardly from an upper part of the bowl-shaped section 21E. The manipulation shaft 21F is provided with a latching projection 21G on its upper peripheral surface, and protuberances on its lower peripheral surface, as will be described later.

A case 22 is provided to cover an opening on top of the substrate 1, and it has an opening 22A in its upper center surface in a position concentric with the supporting rod 3, which defines an inner support of the substrate 1. There is a contact face 22B defining an outer support having an inwardly concaved semispherical shape provided under a periphery of the opening 22A, the contact face 22B being in contact with an outer surface of the bowl-shaped section 21E of the tilting body 21. The case 22 is also provided with guide posts 22D projecting downward from the periphery of the contact face 22B, in a such positional arrangement as to provide a predetermined space with respect to sides of the fringe arms 21C so as to prevent the tilting body 21 from turning about the manipulation shaft 21F.

On an inner peripheral wall of the opening 22A of the case 22, there are Provided with six recessed grooves 22F elongated in an axial direction, in positions corresponding with respective directions where the six pushbutton switches 5 are disposed, and heaped-up portions 22E projecting inwardly and elongated along the axial direction, between adjoining two of the recessed grooves 22F.

Furthermore, on a lower part of an outer periphery of the manipulation shaft 21F of the tilting body 21, there are provided with raised convexity-shaped protuberances 21J for engaging with a corresponding one of the recessed grooves 22F of the case 22 when the manipulation shaft 21F is tilted. There are also clearance slots 21K provided on both sides of each of the protuberances 21J, to serve as clearance spaces of the heaped-up portions 22E during the tilting movement of the manipulation shaft 21F.

A cover 23 has an opening 23A in its center, and a lower surface of it is fixed to a recess 22G in an upper surface of the case 22 with adhesive material or the like. There are markings 23B provided on the cover 23 to indicate six kinds of functions.

A manipulation knob 24 is provided with a disk-shaped manipulation surface 24A, which covers the opening 23A in the cover 23, and a connection post 24C on a lower side, the connection post 24C having a latching hole 24B where the latching projection 21G of the tilting body 21 fits in. The manipulation knob 24 is so constructed that it is secured to the manipulation shaft 21F of the tilting body 21 in a tiltable manner toward any directions of the plurality of markings 23B of the cover 23.

The multi-directional operating switch is completed when a latching hook 22H provided on an outer periphery of the case 22 is engaged with a hook slit 1E in an outer periphery of the substrate 1.

Figure 3:
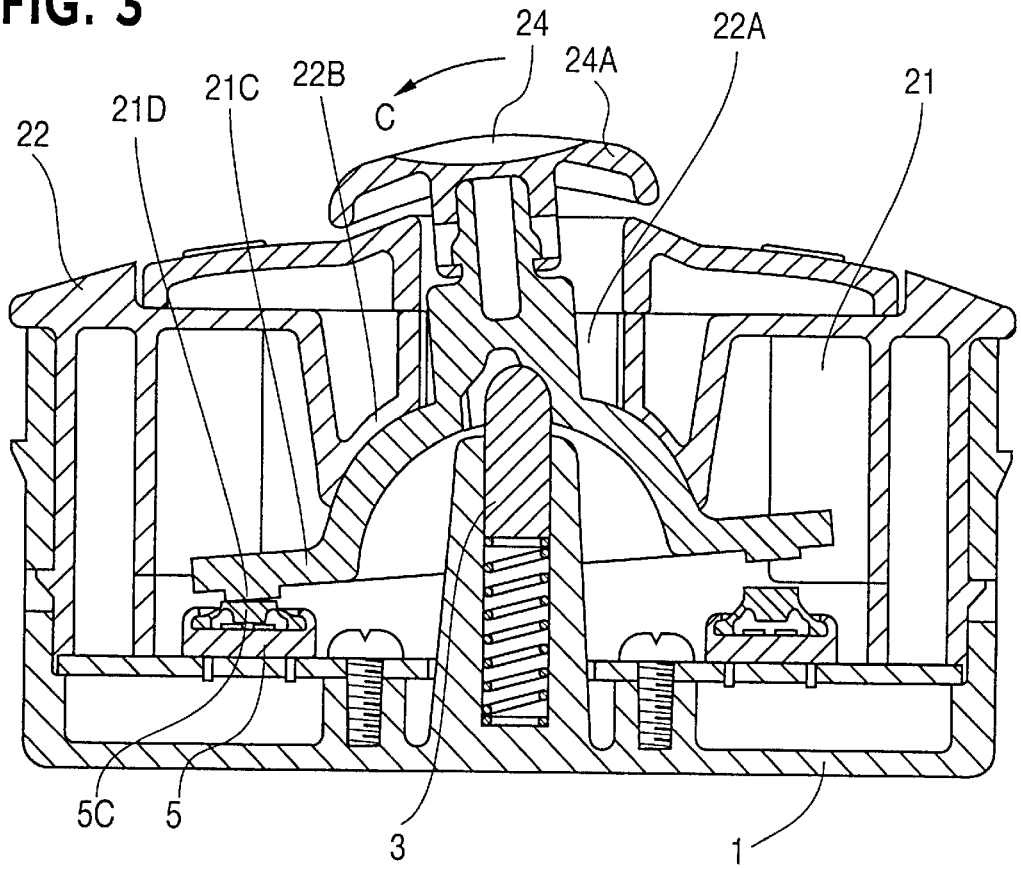
FIG. 3 is a sectioned side view of the same multi-directional operating switch when a manipulation knob is tilted.

In the multi-directional operating switch of the above structure, the tilting body 21 is supported tiltably between the contact face 22B defining the outer support provided under a periphery of the opening 22A of the case 22 and the supporting rod 3 defining the inner support placed in the substrate 1. Therefore, when the manipulation surface 24A of the manipulation knob 24 is tilted toward a direction of an arrow C, as shown in a sectioned side view of FIG. 3 depicting the manipulation knob in the tilted position, the tilting body 21 tilts with an upper end of the supporting rod 3 functioning as the fulcrum, a depressing boss 21D under one of the fringe arms 21C corresponding to this direction depresses a pushbutton 5C of the respective pushbutton switch 5 to close the pushbutton switch 5.

Figure 4A:
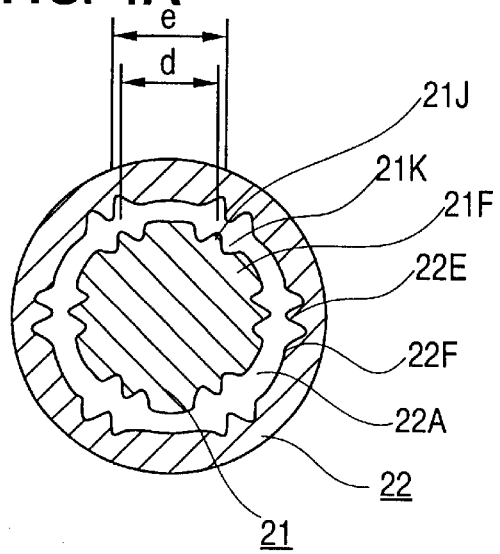
FIGS. 4A, 4B and 4C are sectioned plan views
Figure 4D:
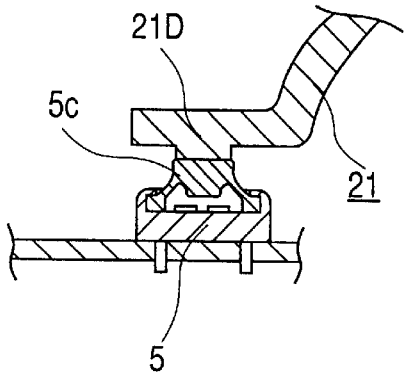
FIGS. 4D, 4E and 4F are sectioned side views depicting operational movements of a case, a tilting body, a depressing boss, and a pushbutton switch of the same multi-directional operating switch.
Figure 4B:
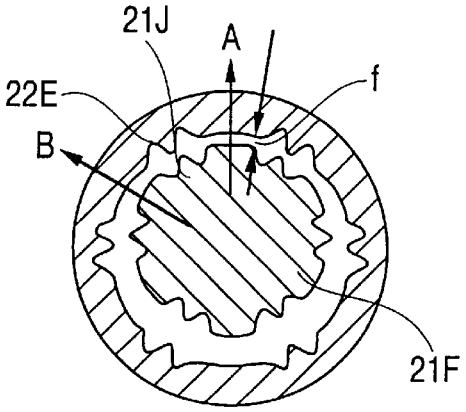
Figure 4E:
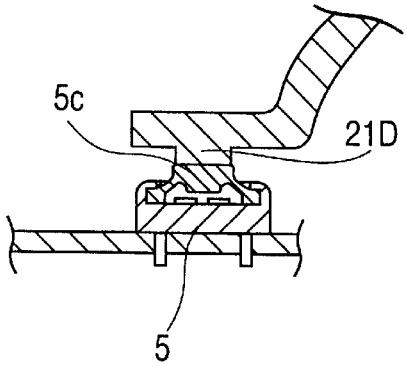
Figure 4C:
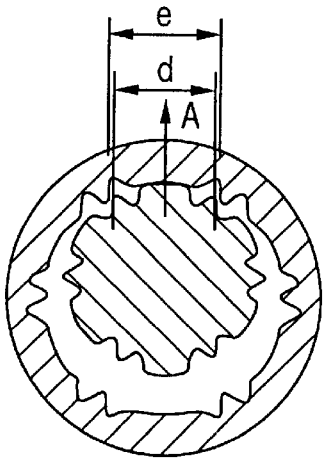
Figure 4F:
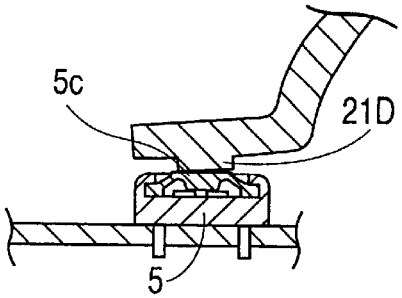

FIGS. 4A–4F are sectional views depicting operational movements of the case 22, the tilting body 21, the depressing boss 21D of the tilting body 21, and the pushbutton switch 5. In FIGS. 4A and 4D the manipulation shaft 21 F is so designed that a widthwise dimension "d" of the protuberances 21J on the lower part of its outer periphery is slightly smaller than a width dimension "e" of the recessed grooves 22F in the opening 22A of the case 22. Therefore, the protuberances 21J move in a position where they fit in the groove 22F, as shown in FIG. 4C, when the manipulation shaft 21F shifts in the direction of A, and thereby the pushbutton switch 5 turns into its ON state as shown in FIG. 4F. However, if the manipulation shaft 21F shifts toward a position generally midway between the directions A and B, as the direction of tilting manipulation of the manipulation knob deviates as shown in FIG. 4B, an edge of the protuberance 21J and a crest of the heaped-up portion 22E strike against each other. This ensures a space "f" between the protuberances 21J and the recessed groove 22F, so as not to cause the pushbutton switch 5 to turn on, although the pushbutton 5C is slightly depressed downward as shown in FIG. 4E.

Moreover, since the edge of the protuberance 21J and the crest of the heaped-up portion 22E are of acute angles, the manipulation shaft 21F is guided either side towards the A direction or the B direction, when the direction of tilting manipulation of the manipulation knob 24 is deviated slightly. Therefore, this makes it possible to turn into an ON state only one of the pushbutton switches 5 corresponding to the desired direction, but not two adjoining pushbutton switches 5 at the same time, even if the direction of tilting manipulation of the manipulation knob 24 is deviated.

As described, the structure of this exemplary embodiment realizes a multidirectional operating switch of excellent operability, as it avoids an adjoining pushbutton switch from being depressed and turned into an ON state unintentionally even if the manipulation shaft is tilted inadvertently in a slightly deviated direction toward the adjoining pushbutton switch, since one of the protuberances provided on the manipulation shaft is guidingly engaged into one of the recessed grooves provided in the opening of the case.

In the above-described exemplary embodiment, there is prescribed only a widthwise dimension of the plurality of recessed grooves 22F provided in the opening 22A of the case 22. However, in addition to the widthwise dimension of the recessed grooves 22F, a depth dimension may be set at such a value that is at least equal to, but substantially close to, a distance required for the manipulation shaft to shift and turn on the pushbutton switch 5. This makes the recessed grooves 22F function as a stopper of the manipulation shaft 21F, so as to alleviate an excessive depressing force from being applied to the pushbutton switch 5, even if an excessive manipulating force is placed on the manipulation shaft 21F during a tilting manipulation, thereby making the multidirectional operating switch highly reliable.

Figure 9:
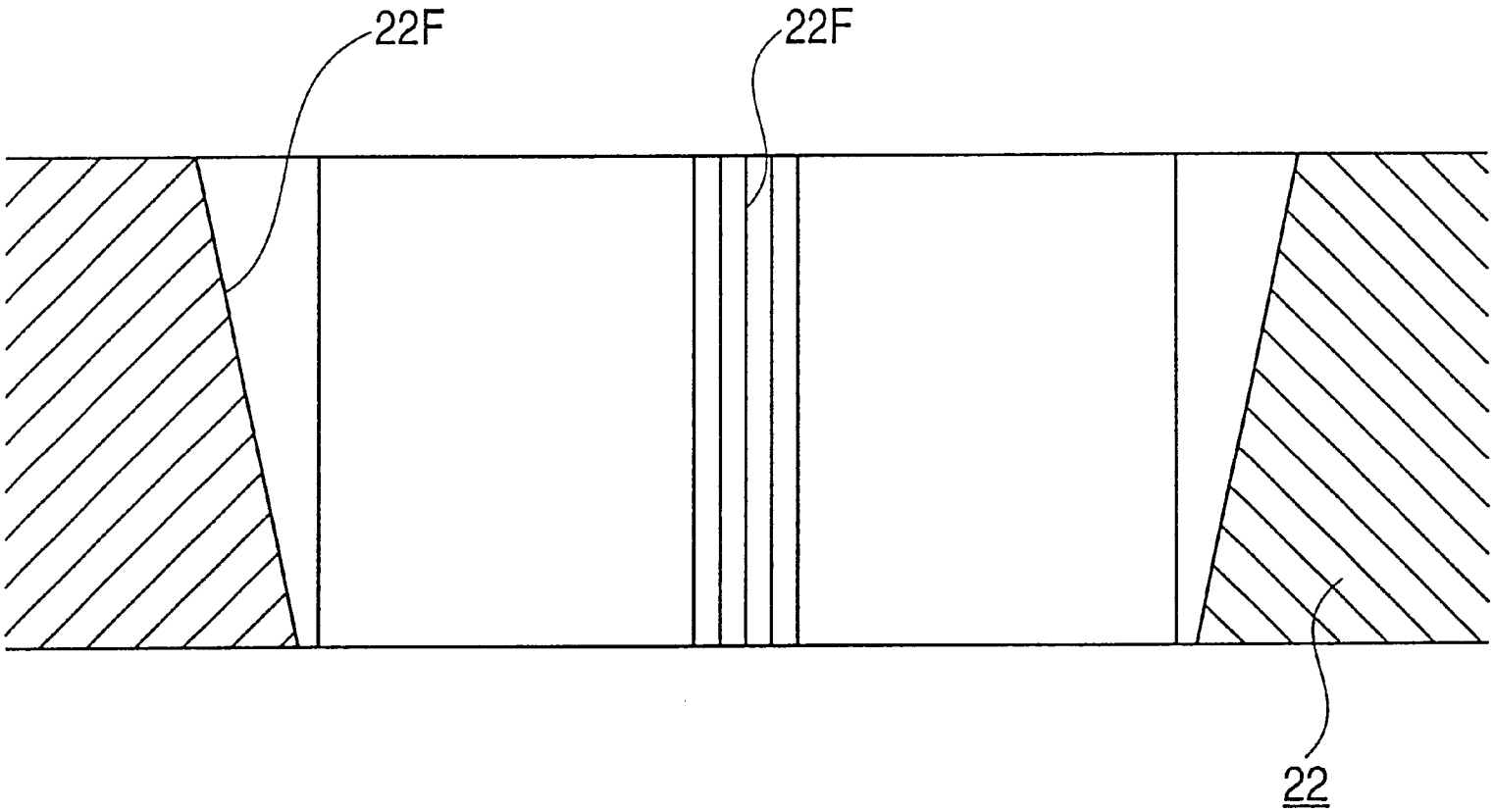
FIG. 9 is a schematically illustrated partially sectional view of a case with sloped recessed grooves.

Also, in the above exemplary embodiment, the recessed grooves 22F provided in the opening 22A of the case 22 are arranged in parallel along the axial direction from the upper peripheral surface of the opening 22A. However, the recessed grooves 22F may be sloped in such a manner that a depth dimension of the recessed grooves 22F becomes smaller from the upper peripheral surface toward the lower portion of the opening 22A, as schematically illustrated in FIG. 9. This can prevent a deformation of the protuberances 21J and so on, as the sloped recessed grooves 22F receive the protuberances 21J of the manipulation shaft 21F in a surface-to-surface contact, and disperse an excessive depressing force, if an excessive manipulating force is placed on the manipulation shaft 21F, thereby making the multi-directional operating switch highly reliable.

Further, in the above exemplary embodiment, an outer peripheral surface of the bowl-shaped section 21E of the tilting body 21 is biased into a surface contact with the contact face 22B under the periphery of the opening 22A of the case 22. Instead, a protuberance may be provided on any of the outer peripheral surface of the bowl-shaped section 21E and the contact face 22B of the case 22, so as to make them maintain a linear contact with each other. The provision of the protuberance can yield a stable manipulatory feeling, as it lessens a frictional resistance in tilting manipulation of the tilting body 21, and reduces sliding wear.

Moreover, although the above exemplary embodiment has the structure in which the cover 23 is disposed on the case 22, the cover 23 and the case 22 may be combined into a single structure.

Further, in the above exemplary embodiment, the manipulation knob 24 is fixed to the manipulation shaft 21F of the tilting body 21 in a manner to cover the opening 23A of the cover 23. However, the manipulation knob 24 may be omitted by altering the manipulation shaft 21F into such a shape as to be functionable as a manipulation knob, if a consideration is not required for dustproofing, and the like.

The present exemplary embodiment is an example, in which the tilting body 21 is provided with six portions of the radially extending fringe arm 21C, and six sets of the pushbutton switch 5 are disposed on the wiring substrate 4. However, a number of the fringe arms 21C and the pushbutton switches 5 is not limited to six, but they can be of any other desired number such as three, four, and so on. If such is the case, a number of the recessed grooves 22F provided in the opening 22A of the case 22 and the protuberances 21J on the manipulation shaft 21F shall also be matched with the number of the pushbutton switches 5, as is needless to note.

Second Exemplary Embodiment

Figure 5:
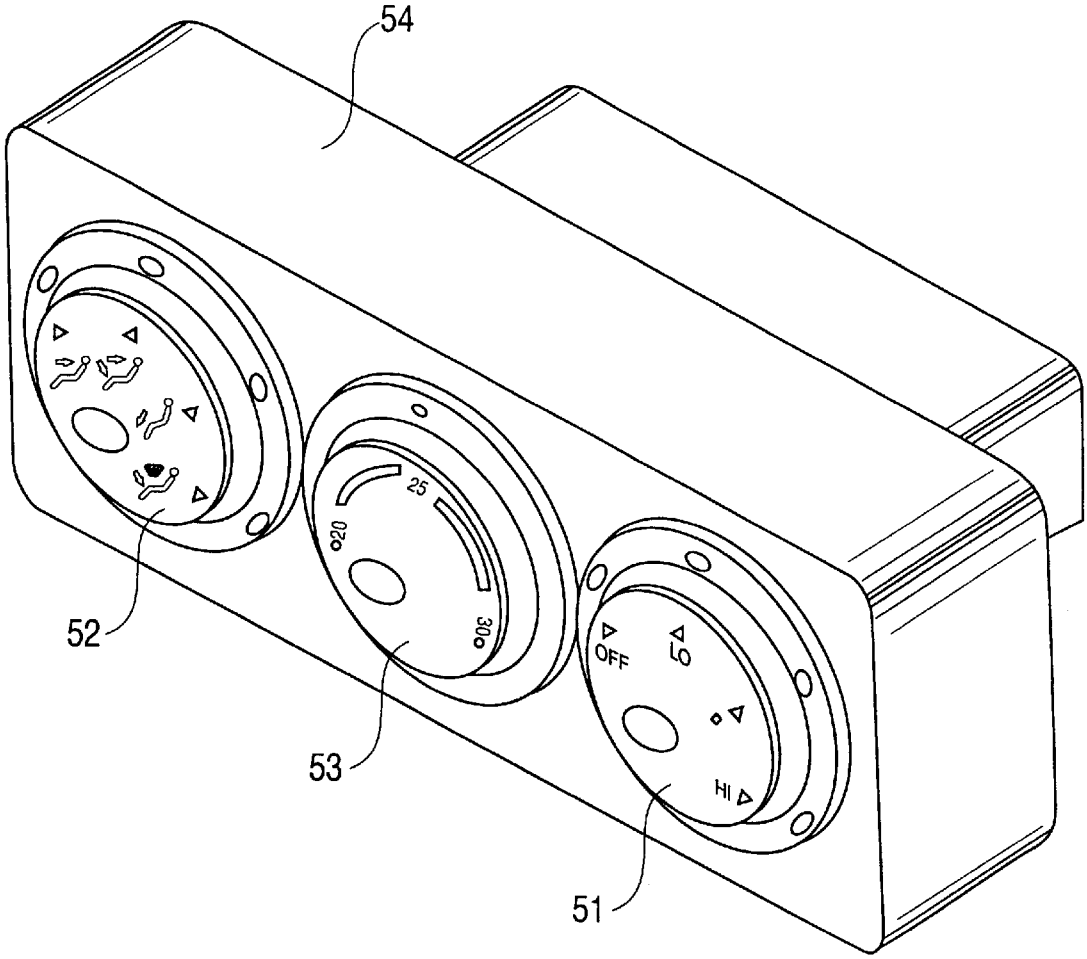
FIG. 5 is a perspective exterior view of an electronic device equipped with multi-directional operating switches in a second exemplary embodiment of the present invention.
Figure 6:
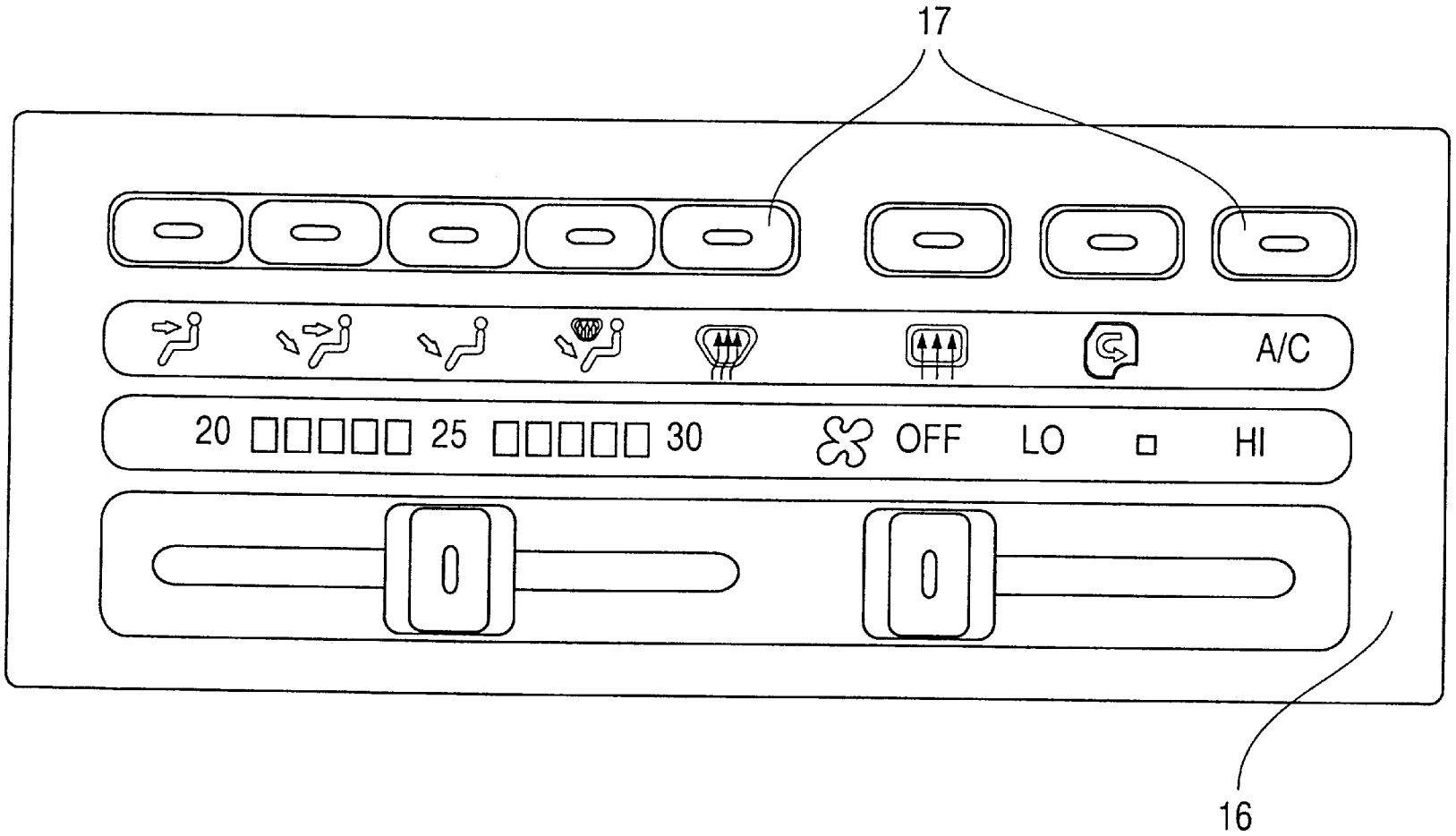
FIG. 6 (PRIOR ART)
FIG. 6 is a front view of an air-conditioning control device equipped with an operating switch of the prior art.
Figure 7:
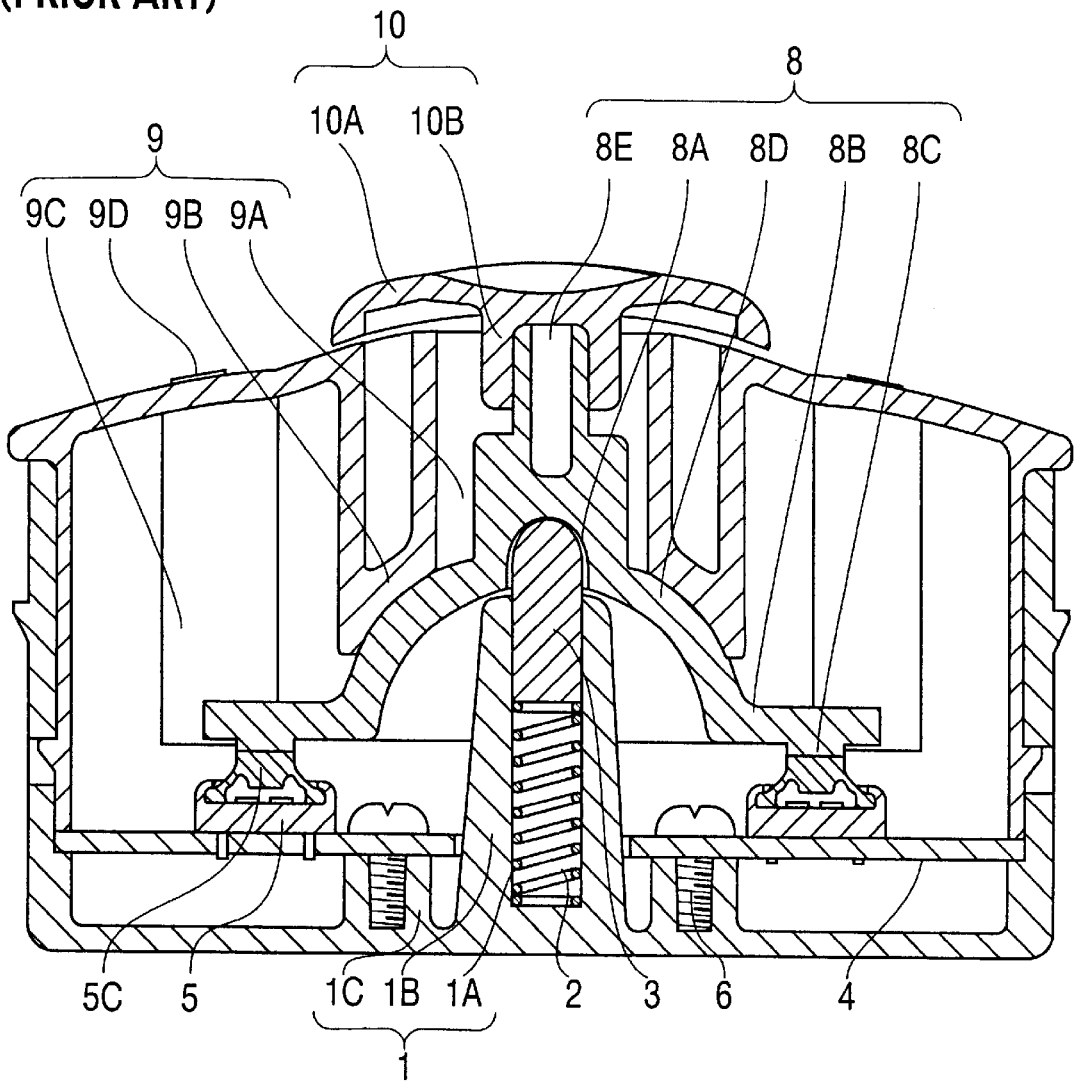
FIG. 7 (PRIOR ART)
FIG. 7 is a sectioned side view of a multi multi-directional operating switch of the prior art.
Figure 8:
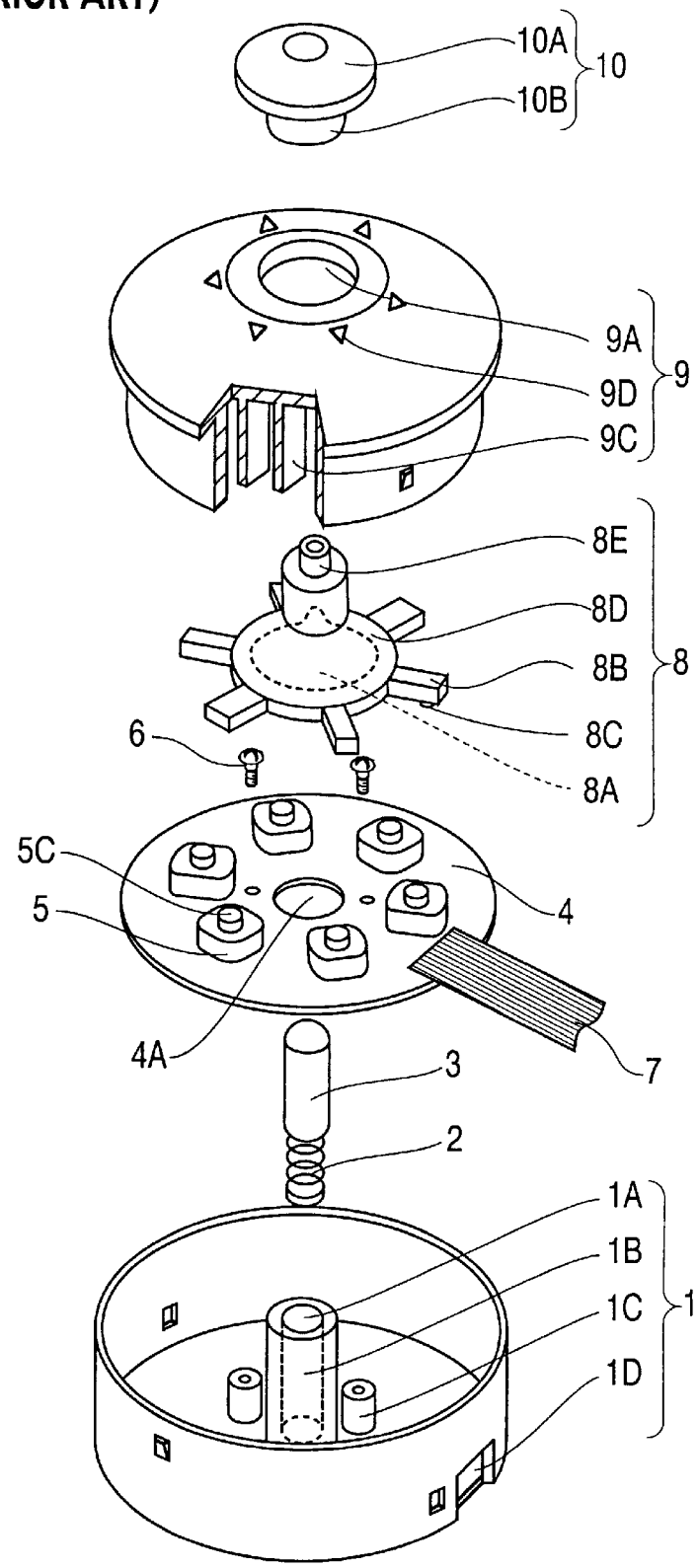
FIG. 8 (PRIOR ART)
FIG. 8 is an exploded perspective view of the same multi-directional operating switch.

FIG. 5 is a perspective exterior view of an electronic device equipped with multi-directional operating switches in a second exemplary embodiment of the present invention, and it is an example representing an air-conditioning control device for use in an automobile. In this exemplary embodiment, a number of multi-directional operating switches of the first exemplary embodiment are disposed for individual air-conditioning functions, such as an air delivery control switch 51, an air-conditioning control switch 52, and a temperature control switch 53, on an air-conditioning control device 54, defining a frame, for use in an automobile.

As described, the present exemplary embodiment realizes a consolidated arrangement of a plurality of functions into one or more multi-directional operating switches, thereby providing an electronic device of superior operability not requiring a large movement of a hand in manipulation of the plurality of functions with a simple structure.

According to the present invention as described above, there are provided the multi-directional operating switches of excellent operability and the electronic device using the same switch, wherein any pushbutton switch other than a desired one is not unintentionally depressed and turned into an ON state, even if the manipulation knob is tilted inadvertently toward a direction deviated from the desired pushbutton switch, since one of the protuberances provided on the manipulation shaft is guidingly engaged into one of the recessed grooves provided in the opening of the case.

What is claimed is:

1. A multi-directional operating switch comprising:

a box-shaped case having an opening in an upper surface thereof, and an outer support provided under an outer periphery of said opening;

a substrate disposed under said box-shaped case, said substrate provided with an inner support in a position concentrical with said opening;

a tilting body provided with a bowl-shaped section supported tiltably between said inner support and said outer support, and having a manipulation shaft projecting upwardly from said bowl-shaped section to an outside through said opening; and a plurality of switch units disposed in a circular configuration, each of said plurality of switch units being turned on and off by a depressing boss provided on a bottom fringe of said bowl-shaped section, wherein an inner peripheral wall of said opening is provided with:

a plurality of recessed grooves elongated in an axial direction of said opening in positions corresponding with respective directions where said plurality of switch units are disposed; and heaped-up portions projecting inwardly and elongated along said axial direction, between adjoining pairs of said plurality of recessed grooves, and further wherein an outer periphery of said manipulation shaft is provided with:

a plurality of protuberances for engaging with a corresponding one of said plurality of recessed grooves in response to a tilting movement of said manipulation shaft; and a clearance slot provided on each side of each of said plurality of protuberances for allowing clearance of said heaped-up portions during the tilting movement.

2. The multi-directional operating switch according to claim 1, wherein a depth dimension of said plurality of recessed grooves is substantially equal to a distance corresponding to a stroke required for said manipulation shaft to turn on and off said plurality of switch units.

3. The multi-directional operating switch according to claim 1, wherein said plurality of recessed grooves are sloped from an upper peripheral surface toward a lower portion of said opening.

4. An electronic device having at least one multi-directional operating switch assigned for individual functions, and a frame for mounting said at least one multi-directional operating switch, said multi-directional operating switch comprising:

a box-shaped case having an opening in an upper surface thereof, and an outer support provided under an outer periphery of said opening;

a substrate disposed under said box-shaped case, said substrate provided with an inner support in a position concentrical with said opening;

a tilting body provided with a bowl-shaped section supported tiltably between said inner support and said outer support, and having a manipulation shaft projecting upwardly from said bowl-shaped section to an outside through said opening; and a plurality of switch units disposed in a circular configuration, each of said plurality of switch units being turned on and off by a depressing boss provided on a bottom fringe of said bowl-shaped section, wherein an inner peripheral wall of said opening is provided with:

a plurality of recessed grooves elongated in an axial direction of said opening in positions corresponding with respective directions where said plurality of switch units are disposed; and heaped-up portions projecting inwardly and elongated along said axial direction, between adjoining pairs of said plurality of recessed grooves, and further wherein an outer periphery of said manipulation shaft is provided with:

a plurality of protuberances for engaging with a corresponding one of said plurality of recessed grooves in response to a tilting movement of said manipulation shaft; and a clearance slot provided on each side of each of said plurality of protuberances for allowing clearance of said heaped-up portions during the tilting movement.

* * * * *